US007185865B1

(12) United States Patent
Patrick

(10) Patent No.: US 7,185,865 B1
(45) Date of Patent: Mar. 6, 2007

(54) TISSUE PAPER SUPPORTING ASSEMBLY

(76) Inventor: Sharon D. Patrick, 1289 Schafer Dr., Burton, MI (US) 48509

( * ) Notice: Subject to any disclaimer, the term of this patent is extended or adjusted under 35 U.S.C. 154(b) by 207 days.

(21) Appl. No.: 10/739,206

(22) Filed: Dec. 19, 2003

(51) Int. Cl.
*A47H 1/10* (2006.01)

(52) U.S. Cl. ..... 248/318; 248/128; 248/309.1; 248/905; 211/71.01

(58) Field of Classification Search ..... 248/905, 248/318, 215, 128, 146, 309.1, 311.2, 302, 248/175, 304, 316.8; 5/503.1; 211/106, 211/13.1, 71.01, 72, 73
See application file for complete search history.

(56) References Cited

U.S. PATENT DOCUMENTS

| | | | | | |
|---|---|---|---|---|---|
| 1,738,425 | A | | 12/1929 | Evans | |
| 2,470,890 | A | * | 5/1949 | Goodpasture | 248/302 |
| 2,672,988 | A | * | 3/1954 | Johnson | 211/88.01 |
| 2,992,854 | A | * | 7/1961 | Berlin | 297/256 |
| 3,019,908 | A | | 2/1962 | Theurer | |
| 3,089,597 | A | * | 5/1963 | Kaplan | 224/400 |
| 3,489,385 | A | * | 1/1970 | Dill, Jr. | 248/311.2 |
| 3,591,120 | A | * | 7/1971 | Fietzer et al. | 248/311.3 |
| 3,674,191 | A | | 7/1972 | Goings | |
| D251,999 | S | * | 6/1979 | Bautista, Jr. | D6/525 |
| 4,730,758 | A | * | 3/1988 | McMurtrey | 224/417 |
| D298,500 | S | * | 11/1988 | Hisey | D6/567 |
| 5,213,243 | A | | 5/1993 | Landon | |
| 5,398,856 | A | | 3/1995 | Shyu | |
| D367,790 | S | * | 3/1996 | Munoz et al. | D6/525 |
| 6,170,725 | B1 | | 1/2001 | Ganues | |
| 6,285,544 | B1 | * | 9/2001 | Chandramohan | 361/680 |
| 6,329,583 | B1 | * | 12/2001 | May | 84/421 |
| 6,398,174 | B1 | * | 6/2002 | Emalfarb | 248/214 |
| 6,464,086 | B1 | * | 10/2002 | Klein et al. | 211/35 |
| 6,488,246 | B2 | * | 12/2002 | Song | 248/175 |
| 6,561,399 | B1 | * | 5/2003 | Loosbrock | 224/403 |
| 2001/0019072 | A1 | | 9/2001 | Wu | |

* cited by examiner

*Primary Examiner*—Amy J. Sterling

(57) ABSTRACT

A tissue paper supporting assembly includes a panel that has a rear edge, a forward edge and a pair of lateral side edges. Each of pair of legs has a lower end that is attached to and extends upwardly from the rear edge. The legs are spaced from each other such that each of the legs is positioned adjacent to one of the side edges. The legs are each positioned in a plane orientated substantially perpendicular to a plane of the panel. A bracket is attached to the legs and extends over the panel such that a plane of the bracket is orientated substantially parallel to the plain of the panel. A coupler is attached to an upper end of the legs for selectively coupling the legs to a vertical surface. A tissue holding box may be removably positioned on the panel and held against the legs by the bracket.

18 Claims, 4 Drawing Sheets

TISSUE PAPER SUPPORTING ASSEMBLY

BACKGROUND OF THE INVENTION

1. Field of the Invention

The present invention relates to tissue paper holding devices and more particularly pertains to a new tissue paper holding device for supporting a box of tissue paper on a vertical surface.

2. Description of the Prior Art

The use of tissue paper holding devices is known in the prior art. These devices, like those found in U.S. Pat. No. 6,170,725 and U.S. Pat. No. 5,398,856, typically include assemblies having a structure suited for mounting tissue boxes within a vehicle. Other popular structures include those such as U.S. Pat. No. 5,213,243 which are adapted for changing the appearance of a tissue box by providing a cover, or sheath, for the box itself.

While these devices fulfill their respective, particular objectives and requirements, the need remains for a device that is adapted for securing, or holding, a conventional box of tissue on vertical surface. The vertical surface may include a wall or door. This would allow the owner of the tissue to position the tissue in convenient locations such on the back of a bathroom door or upon a wall when a sink or table is not available. As tissue boxes can use a relatively large amount of space relative to other bathroom accessories, a device adapted for mounting the tissue paper on a wall or a door would be a valuable space saving device.

SUMMARY OF THE INVENTION

The present invention meets the needs presented above by generally comprising a panel that has a rear edge, a forward edge and a pair of lateral side edges. Each of pair of legs has a lower end that is attached to and extends upwardly from the rear edge. The legs are spaced from each other such that each of the legs is positioned adjacent to one of the side edges. The legs are each positioned in a plane orientated substantially perpendicular to a plane of the panel. A bracket is attached to the legs and extends over the panel such that a plane of the bracket is orientated substantially parallel to the plain of the panel. A coupler is attached to an upper end of the legs for selectively coupling the legs to a vertical surface. A tissue holding box may be removably positioned on the panel and held against the legs by the bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
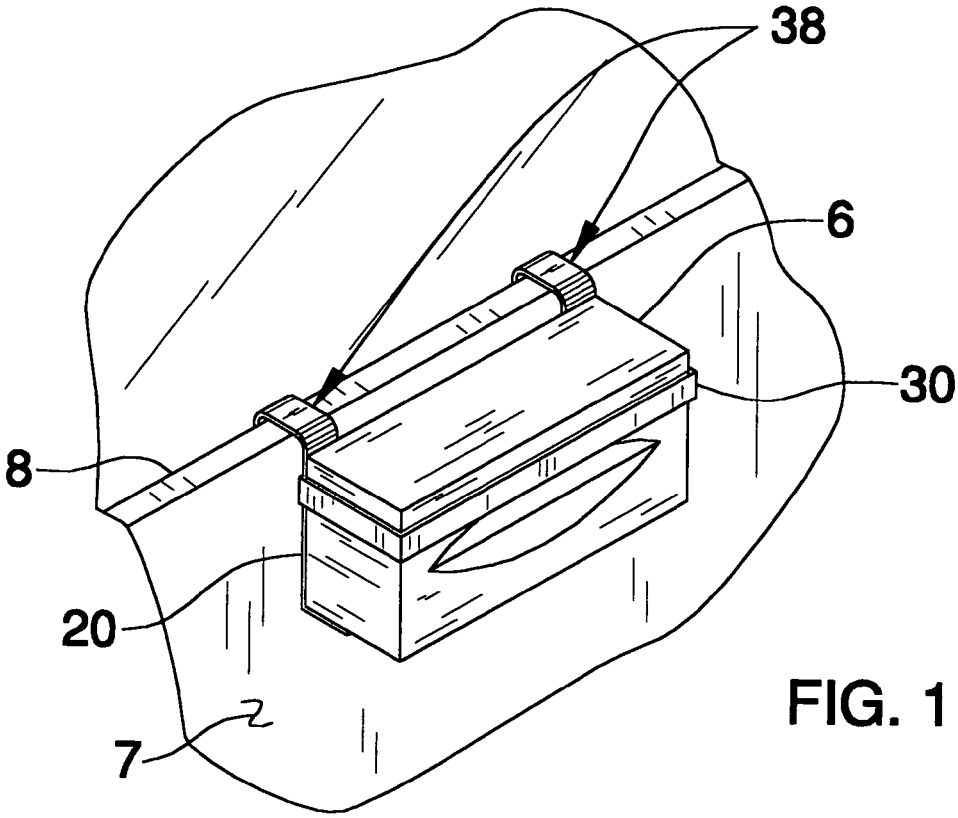
FIG. 1 is a schematic perspective view of a tissue paper supporting assembly according to the present invention.
Figure 2:
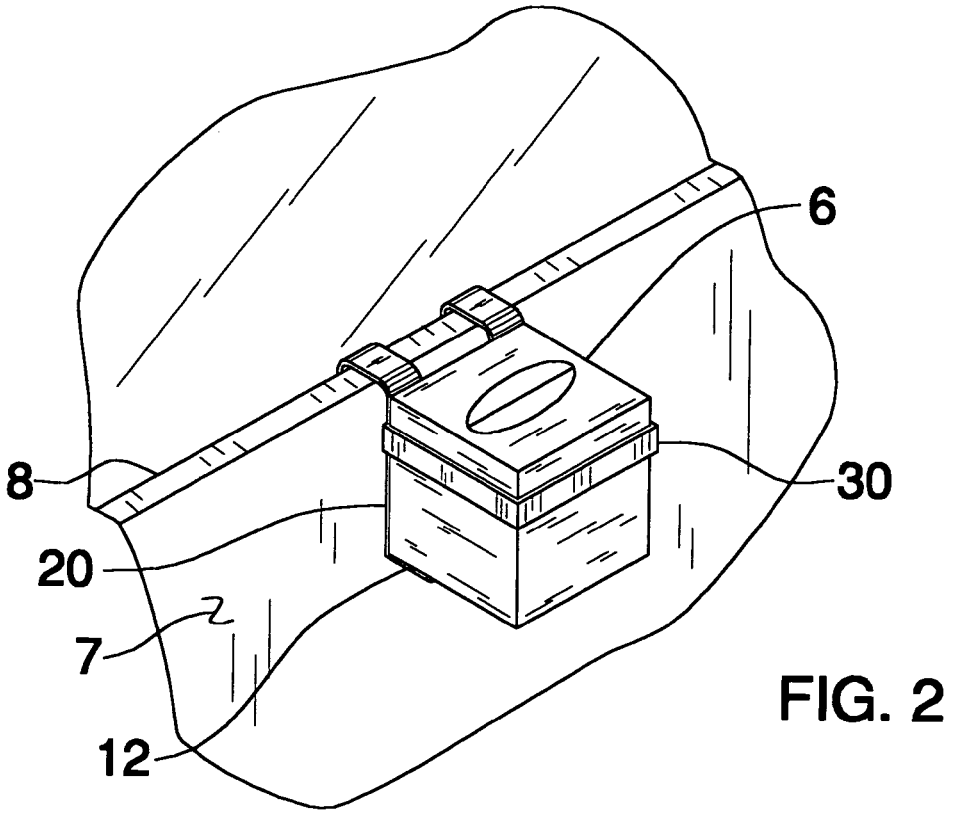
FIG. 2 is a schematic perspective view of the present invention.
Figure 3:
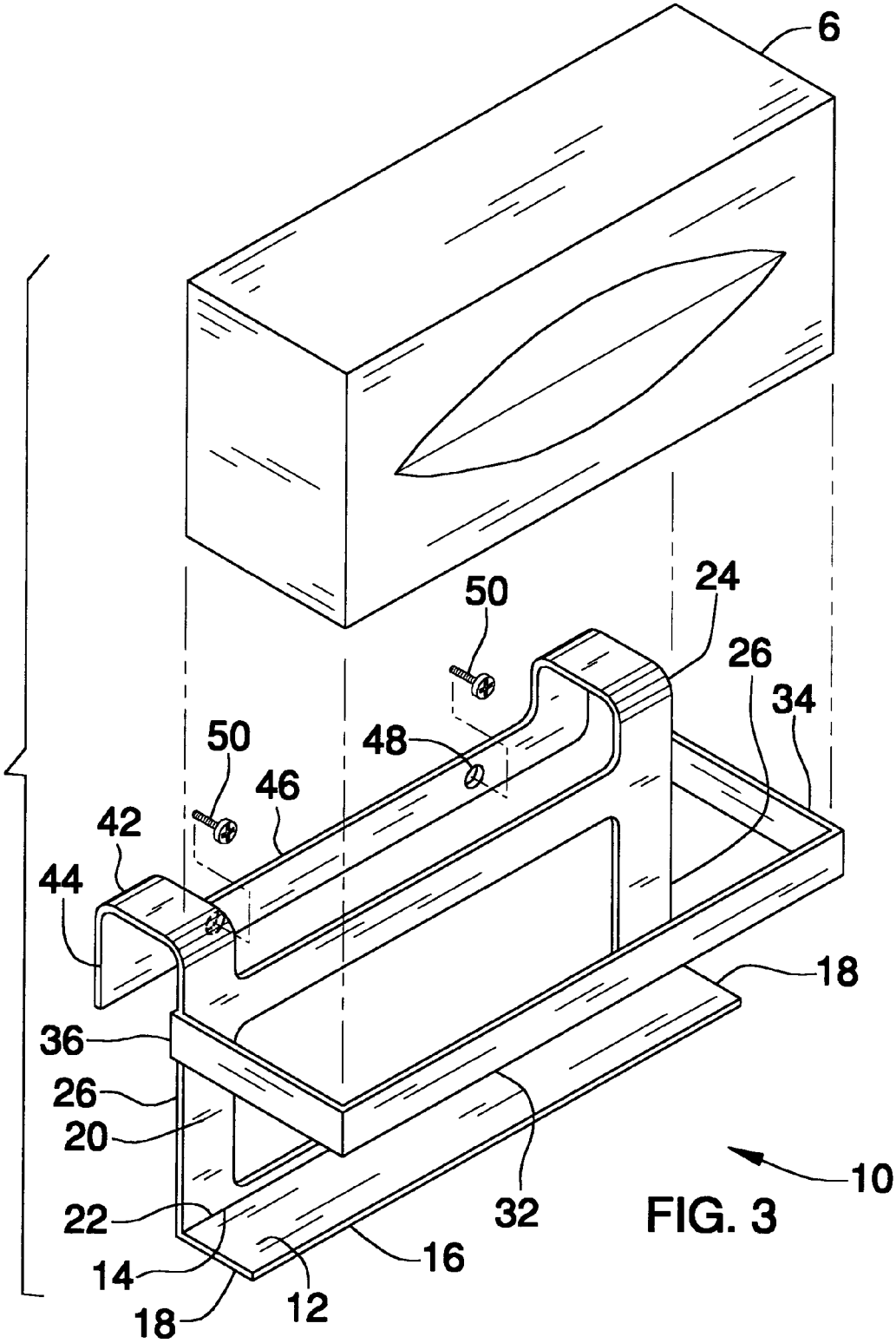
FIG. 3 is a schematic perspective view of the present invention.
Figure 4:
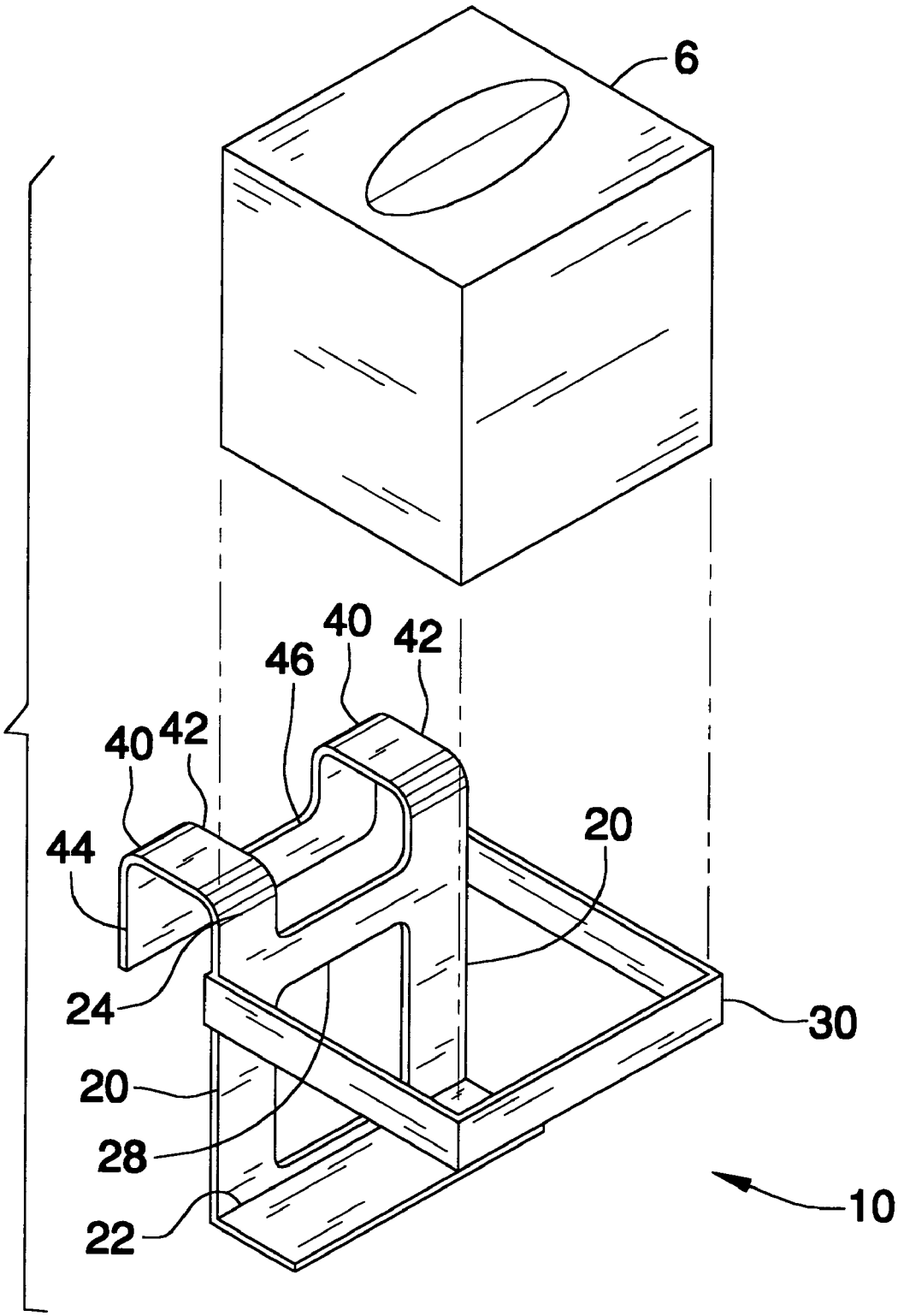
FIG. 4 is a schematic perspective view of the present invention.

With reference now to the drawings, and in particular to FIGS. 1 through 5 thereof, a new tissue paper holding device embodying the principles and concepts of the present invention and generally designated by the reference numeral 10 will be described.

As best illustrated in FIGS. 1 through 5, the tissue paper supporting assembly 10 generally includes a panel 12 that has a rear edge 14, a forward edge 16 and a pair of lateral side edges 18. The panel 12 has a width from the rear edge 14 to the forward edge 16 generally between 1 inch and 2 inches. The panel 12 has a length between the side edges 18 generally between 4 inches and 10 inches. Ideally, the panel 12 will have a length between 4 inches and 5 inches or between 9 inches or 10 inches to accommodate the different sizes of standard tissue dispensing boxes 6.

Each of a pair of legs 20 a lower end 22. The lower ends 22 are each attached to the panel 12 such that the legs 20 extend upwardly from the rear edge 14. The legs 20 are spaced from each other such that each of the legs 20 is positioned adjacent to one of the side edges 18. Each of the legs 20 is positioned in a plane orientated substantially perpendicular to a plane of the panel 12. The legs 20 each have a height generally between 4 inches and 5 inches. The legs 20 have an outer edge 26 defined with respect to each other. A brace 28 is attached to and extends between the legs 20. The brace 28 adds stability to the structure of the assembly 10.

A bracket 30 is attached to the legs 20 and extends over the panel 12 such that a plane of the bracket 30 is orientated substantially parallel to the plain of the panel 12. The bracket 30 includes an elongated member 32 and a pair of arms 34 that are attached to and extend away from opposite ends of the elongated member 32. The arms 34 are orientated perpendicular to the elongated member 32. Each of the arms 34 has a free end 36 with respect to the elongated member. Each of the free ends 36 is attached to one of the legs 20 and are positioned adjacent to a respective one of the outer edges 26 of the legs 20. The elongated member 32 has a length substantially equal to the length of the panel 12.

Figure 5:
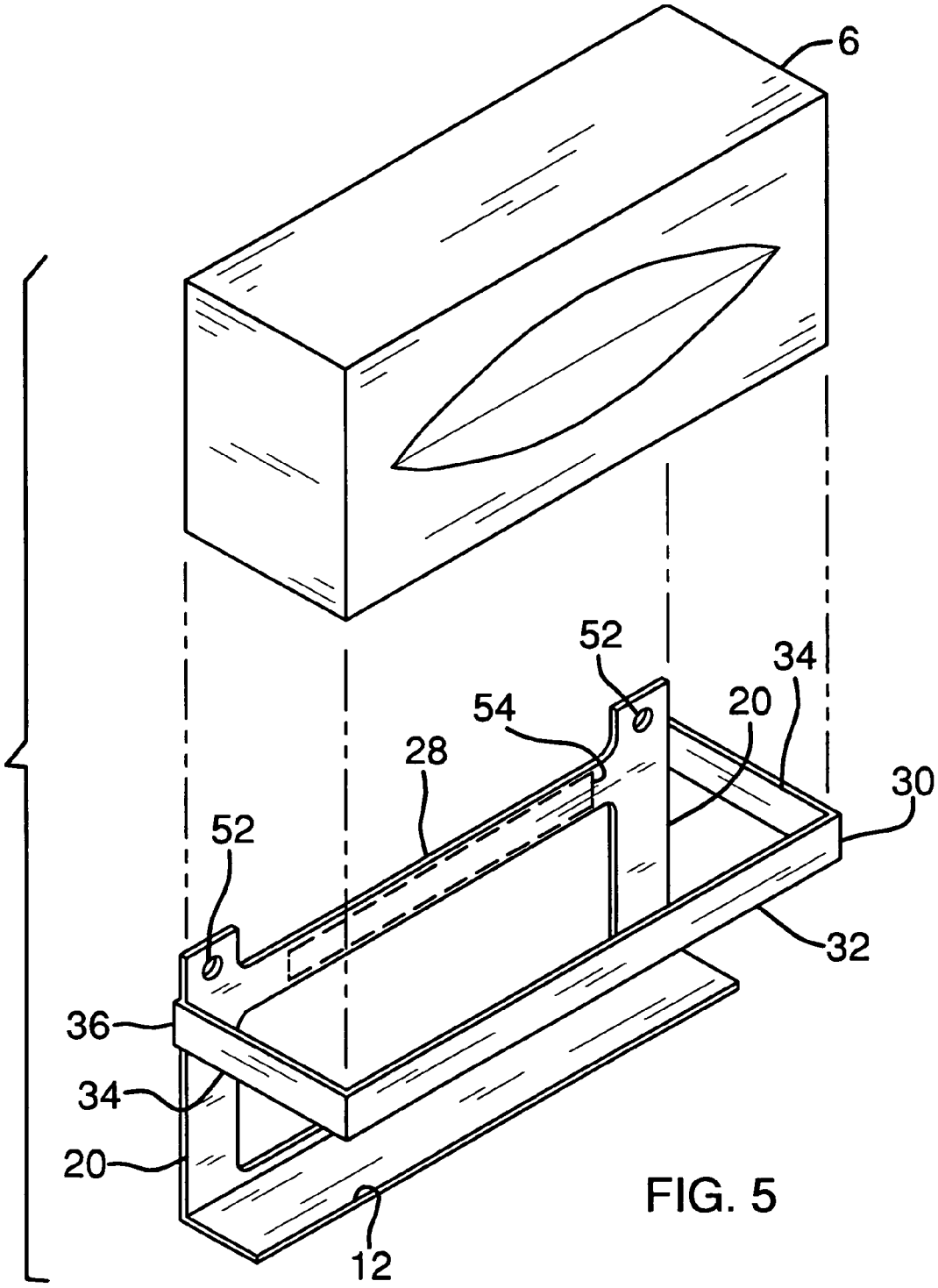
FIG. 5 is a schematic perspective view of a second embodiment of the present invention.

A coupler 38 is attached to an upper end 24 of the legs 20 for selectively coupling the legs 20 to a vertical surface 7. The coupler 38 preferably includes a pair of hooks. Each of the hooks is attached to one of the legs 22. Each of the hooks extends in a direction opposite of the bracket 30. The hooks 40 each include a horizontal portion 42 that is attached to the legs 20 and a downwardly extending vertical portion 44 that is spaced from the legs 20. A support 46 is attached to and extends between the vertical portions 44 of the hooks 40. The hooks 40 may be used for positioning over the edge 8 of a vertical surface 7, such as a door. The support 46 has at least two apertures 48 extending therethrough. The apertures 48 each have an axis orientated perpendicular to the plane of the legs 20. The apertures 48 are spaced from each other and are included for optionally receiving a securing member, such as a screw 50, for screwing the coupler 38 to the vertical surface 7. FIG. 5 depicts an alternate coupler whereby the legs 20 are elongated and each includes a hole 52 extending therethrough, again for receiving a screw 50. Alternatively, a double sided adhesive 54 may be attached to a back side of the brace for attaching this version to a wall surface.

In use, a conventional tissue holding box 6 may be removably positioned on the panel 12 and held against the legs 20 by the bracket 30. Depending on the place for the box 6 to be mounted, the coupler 38 may either be positioned over the edge 8 of a door or fastened to a vertical surface 7 with screws 50.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tissue box holding device comprising:

a panel, said panel having a rear edge, a forward edge and a pair of lateral side edges, said panel having a width from said rear edge to said forward edge generally between 1 inch and 2 inches;

a pair of legs, each of said legs having a lower end being attached to and extending upwardly from said rear edge, each or said legs being fixedly secured relative to said panel said legs being spaced from each other such that each of said legs is positioned adjacent to one of said side edges, each of said legs being positioned in a plane orientated substantially perpendicular to a plane of said panel;

a brace being attached to and extending between said legs;

a bracket being attached to said legs and extending over said panel such that a plane of said bracket is orientated substantially parallel to said plane of said panel;

a coupler being attached to an upper end of said legs for selectively coupling said legs to a vertical surface; and wherein a tissue holding box may be removably positioned on said panel and held against said legs by said bracket.

2. The device according to claim 1, wherein said panel has a length between said side edges generally between 4 inches and 5 inches.

3. The device according to claim 1, wherein said panel has a length between said side edges generally between 9 inches and 10 inches.

4. The device according to claim 1, wherein each of said legs has a height generally between 4 inches and 5 inches.

5. The device according to claim 1, wherein said bracket includes an elongated member and a pair of arms being attached to and extending away from opposite ends of said elongated member, said arms being orientated perpendicular to said elongated member, each of said arms having a free end with respect to said elongated member, each of said free ends being attached to one of said legs.

6. The device according to claim 5, wherein each of said legs has an outer edge with respect to each other, each of said free ends being positioned adjacent to a respective one of said outer edges of said legs.

7. The device according to claim 5, wherein said elongated member has a length substantially equal to said length of said panel.

8. The device according to claim 5, wherein said coupler includes a pair of hooks, each of said hooks being attached to one of said legs, each of said hooks extending in a direction opposite of said bracket.

9. The device according to claim 8, wherein each of said hooks includes a horizontal portion attached to said legs and a downwardly extending vertical portion spaced from said legs.

10. The device according to claim 9, further including a support being attached to and extending between said vertical portions of said hooks.

11. The device according to claim 10, wherein said support has at least two apertures extending therethrough, each of said apertures having an axis orientated perpendicular to said plane of said legs, said apertures being spaced from said hooks.

12. A tissue box holding device comprising:

a panel, said panel having a rear edge, a forward edge and a pair of lateral side edges, said panel having a width from said rear edge to said forward edge generally between 1 inch and 2 inches, said panel having a length between said side edges generally between 4 inches and 10 inches;

a pair of legs, each of said legs having a lower end being attached to and extending upwardly from said rear edge, each of said legs being fixedly secured relative to said panel said legs being spaced from each other such that each of said legs is positioned adjacent to one of said side edges, each of said legs being positioned in a plane orientated substantially perpendicular to a plane of said panel, each of said legs having a height generally between 4 inches and 5 inches, each of said legs having an outer edge with respect to each other;

a bracket being attached to said legs and extending over said panel such that a plane of said bracket is orientated substantially parallel to said plane of said panel, said bracket including an elongated member and a pair of arms being attached to and extending away from opposite ends of said elongated member, said arms being orientated perpendicular to said elongated member, each of said arms having a free end with respect to said elongated member, each of said free ends being attached to one of said legs, each of said free ends being positioned adjacent to a respective one of said outer edges of said legs, said elongated member having a length substantially equal to said length of said panel;

a coupler being attached to an upper end of said legs for selectively coupling said legs to a vertical surface;

a brace being attached to and extending between said legs; and wherein a tissue holding box may be removably positioned on said panel and held against said legs by said bracket.

13. The tissue box holding device according to claim 12, wherein said coupler includes a pair of screws each being removably extendable through a hole in each of said legs and into the vertical surface.

14. The tissue box holding device according to claim 12, wherein said coupler including a pair of hooks, each of said hooks being attached to one of said legs, each of said hooks extending in a direction opposite of said bracket, each of said hooks including a horizontal portion attached to said legs and a downwardly extending vertical portion spaced from said legs, a support being attached to and extending between said vertical portions of said hooks, said support having at least two apertures extending therethrough, each of said apertures having an axis orientated perpendicular to said plane of said legs, each of said apertures being spaced from said legs.

15. A method of holding a tissue box comprising the steps of:

providing a panel having a rear edge, a forward edge and a pair of lateral side edges, said panel having a width from said rear edge to said forward edge generally between 1 inch and 2 inches;

providing a pair of legs, each of said legs having a lower end being attached to and extending upwardly from said rear edge, each of said legs being fixedly secured relative to said panel said legs being spaced from each other such that each of said legs is positioned adjacent to one of said side edges, each of said legs being positioned in a plane orientated substantially perpendicular to a plane of said panel, each of said legs having an outer edge with respect to each other;

providing a bracket being attached to said legs and extending over said panel such that a plane of said bracket is orientated substantially parallel to said plane of said panel, said bracket including an elongated member and a pair of arms being attached to and extending away from opposite ends of said elongated member, said arms being orientated perpendicular to said elongated member, each of said arms having a free end with respect to said elongated member, each of said free ends being attached to one of said legs, each of said free ends being positioned adjacent to a respective one of said outer edges of said legs, said elongated member having a length substantially equal to said length of said panel;

providing a coupler being attached to an upper end of said legs for selectively coupling said legs to a vertical surface;

providing a brace being attached to and extending between said legs;

positioning a tissue box on said panel such that said brace extends around said tissue box; and attaching said upper ends of said legs to a vertical surface with said coupler.

16. The method according to claim 15, wherein said coupler includes a pair of hooks, each of said hooks being attached to one of said legs, each of said hooks extending in a direction opposite of said bracket, each of said hooks including a horizontal portion attached to said legs and a downwardly extending vertical portion spaced from said hooks.

17. The method according to claim 16, wherein said coupler further includes a support being attached to and extending between said vertical portions of said hooks, said support having at least two apertures extending therethrough, each of said apertures having an axis orientated perpendicular to said plane of said legs, each of a pair of screws being extended through one of said apertures in said support and into said vertical surface.

18. The method according to claim 15, wherein said coupler includes a pair of screws, each of said screws being selectively extended through one of a pair of holes in said legs such that said legs are attached to the vertical surface.

* * * * *